US012240659B2

(12) United States Patent
Chen et al.

(10) Patent No.: US 12,240,659 B2
(45) Date of Patent: Mar. 4, 2025

(54) METAL SCREW CAP, POP-TOP CAN AND METAL SCREW CAP MANUFACTURING METHOD

(71) Applicant: ORG TECHNOLOGY CO., LTD., Beijing (CN)

(72) Inventors: YuFei Chen, Beijing (CN); Bo Chen, Beijing (CN)

(73) Assignee: ORG TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 18/198,231

(22) Filed: May 16, 2023

(65) Prior Publication Data

US 2023/0303293 A1 Sep. 28, 2023

Related U.S. Application Data

(63) Continuation of application No. PCT/CN2021/130737, filed on Nov. 15, 2021.

(30) Foreign Application Priority Data

Nov. 16, 2020 (CN) ..... 202011280794.3

(51) Int. Cl.
*B65D 41/08* (2006.01)

(52) U.S. Cl.
CPC ..... *B65D 41/08* (2013.01)

(58) Field of Classification Search
CPC ..... B65D 41/08; B65D 41/06; B65D 41/04; B21D 51/50; A47G 19/2272; A47G 19/2266

(Continued)

(56) References Cited

U.S. PATENT DOCUMENTS 4,262,815 A 4/1981 Klein
4,774,839 A 10/1988 Caleffi et al.

(Continued)

FOREIGN PATENT DOCUMENTS

CN 1171751 A 1/1998
CN 2609862 4/2004

(Continued)

OTHER PUBLICATIONS

First Office Action issued in related Chinese Application No. 202011280794.3, on Apr. 6, 2022, in 12 pages.

(Continued)

*Primary Examiner* — Robert J Hicks
(74) *Attorney, Agent, or Firm* — Davis Wright Tremaine LLP

(57) ABSTRACT

A metal screw cap (1), a pop-top can and a metal screw cap (1) manufacturing method. The metal screw cap (1) includes a screw cap body (10), where an inner wall of the screw cap body (10) encloses a channel for liquid to flow out; the screw cap body (10) includes a threaded portion (11), an arc-shaped portion (12) and an hemming portion (13); the arc-shaped portion (12) includes a plurality of circular arc-shaped segments connected end to end; the threaded portion (11) is used for threaded sealing connection with a lid, and the hemming portion (13) is used for seaming with a turned edge of a can body. The pop-top can includes the can body and the metal screw cap (1). The metal screw cap (1) manufacturing method is used for manufacturing the metal screw cap (1).

10 Claims, 6 Drawing Sheets

(58) Field of Classification Search
USPC ..... 220/293, 288, 703, 711, 713; 413/6, 4
See application file for complete search history.

(56) References Cited

U.S. PATENT DOCUMENTS

| | | | | |
|---|---|---|---|---|
| 4,961,510 | A * | 10/1990 | Dvoracek | B65D 25/48 220/717 |
| 2021/0048128 | A1* | 2/2021 | Marici | F16L 15/06 |
| 2021/0068520 | A1* | 3/2021 | Chung | A47G 19/2272 |

FOREIGN PATENT DOCUMENTS

| | | |
|---|---|---|
| CN | 2661627 | 12/2004 |
| CN | 1812915 A | 8/2006 |
| CN | 201201738 | 3/2009 |
| CN | 204776391 | 11/2015 |
| CN | 205837387 | 12/2016 |
| CN | 209209289 | 8/2019 |
| CN | 110576116 | 12/2019 |
| CN | 210708308 | 6/2020 |
| CN | 212220855 | 12/2020 |
| CN | 112340214 | 2/2021 |
| CN | 214190816 | 9/2021 |
| JP | 2000296866 | 10/2000 |
| JP | 2001063715 | 3/2001 |

OTHER PUBLICATIONS

Concise Explanation of Relevance for CN Decision of Rejection, issued in related Chinese Application No. 202011280794.3, by National Intellectual Property Administration, PRC, on Sep. 13, 2022, in 5 pages.

International Search Report and Written Opinion issued on Jan. 27, 2022 in related International Application No. PCT/CN2021/130737, in 10 pages.

* cited by examiner

METAL SCREW CAP, POP-TOP CAN AND METAL SCREW CAP MANUFACTURING METHOD

CROSS-REFERENCE TO RELATED APPLICATIONS

This application is a continuation of International Application No. PCT/CN2021/130737, filed on Nov. 15, 2021, which claims priority to Chinese Patent Application No. 202011280794.3, filed with the China National Intellectual Property Administration on Nov. 16, 2020, and entitled "METAL SCREW CAP, POP-TOP CAN AND METAL SCREW CAP MANUFACTURING METHOD." The entire contents of which are incorporated herein by reference in their entirety.

TECHNICAL FIELD

The present disclosure relates to the field of packaging container technologies, and in particular, to a metal screw cap, a pop-top can and a metal screw cap manufacturing method.

BACKGROUND

A pop-top can, due to its advantages of easy-to-carry, safe-to-use and high recycling value, is widely used in the packaging of liquid products such as beverage, beer and water, etc.

In the prior art, the pop-top can includes a can body and an easy open end. The can body is provided with a turned edge, and the easy open end is provided with a curling edge. The turned edge on the can body is pressed into the curling edge on the easy open end to form an interlocking structure, and then the interlocking structure is tightly pressed to complete the seaming.

However, the pop-top can in the prior art cannot be resealed after being opened, and when liquid in the pop-top can cannot be drunk up in time, it is prone to be polluted or wasted.

SUMMARY

Embodiments of the present disclosure provides a metal screw cap, a pop-top can and a metal screw cap manufacturing method, so as to solve the problem that a pop-top can cannot be resealed after being opened.

In one aspect, the present disclosure provides a metal screw cap, including a screw cap body;

where an inner wall of the screw cap body encloses a channel for liquid to flow out; and the screw cap body includes a threaded portion, an arc-shaped portion and a hemming portion, the arc-shaped portion is disposed between the threaded portion and the hemming portion, the arc-shaped portion includes a plurality of circular arc-shaped segments connected end to end, the threaded portion is used for threaded sealing connection with a lid, and the hemming portion is used for seaming with a turned edge of a can body.

Optionally, the arc-shaped portion includes a first circular arc-shaped segment, a second circular arc-shaped segment and a third circular arc-shaped segment, a ratio of a radius of the first circular arc-shaped segment to a radius of the second circular arc-shaped segment ranges from 1:16 to 1:1, and a ratio of the radius of the second circular arc-shaped segment to a radius of the third circular arc-shaped segment ranges from 1:2 to 36:1.

Optionally, an annular groove is formed between the hemming portion and the arc-shaped portion; and/or, the hemming portion includes a first hem and a second hem, one end of the first hem is connected with the third circular arc-shaped segment, and the other end of the first hem is connected with the second hem.

Optionally, the threaded portion is provided with a curling edge.

In another aspect, the present disclosure further provides a pop-top can, including a can body and the metal screw cap described above;

where the can body is provided with a turned edge, and the turned edge is seamed with the hemming portion of the metal screw cap.

In yet another aspect, the present disclosure further provides a metal screw cap manufacturing method, applied for the metal screw cap described above and including:

stretching a preform with a cylindrical protrusion to form a first semi-finished product with a step structure;

press forming a lower portion of the step structure to obtain a second semi-finished product with an arc-shaped portion, where the arc-shaped portion includes a plurality of circular arc-shaped segments connected end to end, and at least two of the arc-shaped segments have different radii;

punching a top end of the step structure to obtain a third semi-finished product with an opening portion;

hemming an outer edge of the third semi-finished product to obtain a fourth semi-finished product with a hem; and performing thread forming on the opening portion of the fourth semi-finished product to obtain the metal screw cap.

Optionally, the arc-shaped portion of the second semi-finished product includes a first circular arc-shaped segment, a second circular arc-shaped segment and a third circular arc-shaped segment, and a ratio of a radius of the first circular arc-shaped segment to a radius of the second circular arc-shaped segment ranges from 1:16 to 1:1, and a ratio of the radius of the second circular arc-shaped segment to a radius of the third circular arc-shaped segment ranges from 1:2 to 36:1.

Optionally, the method further includes:

cutting a blank; and blanking and punching the cut blank to form the preform with the cylindrical protrusion.

Optionally, the method further includes: performing necking, bending and pre-curling on the opening portion of the third semi-finished product.

Optionally, the method further includes: rounding the hem of the fourth semi-finished product.

The metal screw cap provided in the present disclosure includes the screw cap body, where the inner wall of the screw cap body encloses a channel for liquid to flow out; the screw cap body includes the threaded portion, the arc-shaped portion and the hemming portion, the arc-shaped portion is disposed between the threaded portion and the hemming portion, the arc-shaped portion includes the plurality of circular arc-shaped segments connected end to end, the threaded portion is used for threaded sealing connection with a lid, and the hemming portion is used for seaming with the turned edge of the can body. By arranging the metal screw cap with the threaded portion, the pop-top can can be resealed after being opened, avoiding the liquid in the pop-top can from being polluted or wasted. Moreover, because the arc-shaped portion of the metal screw cap is arranged in a structure where the plurality of circular arc-shaped segments are connected end to end, when the arc-shaped segments are formed by pressing, or when the pop-top can is filled with liquid posing a certain pressure, the metal screw cap can maintain good stability without collapsing, which is beneficial to improving the yield of the pop-top can.

BRIEF DESCRIPTION OF DRAWINGS

In order to more clearly describe the technical solution in embodiments of the present disclosure or the prior art, the drawings required for the description of the embodiments or the prior art will be briefly introduced below. Obviously, the drawings in the following description are some embodiments of the present disclosure, and for those ordinary skilled in the art, other drawings may be obtained according to these drawings without creative work.

DESCRIPTION OF REFERENCE NUMERALS

Figure 1:
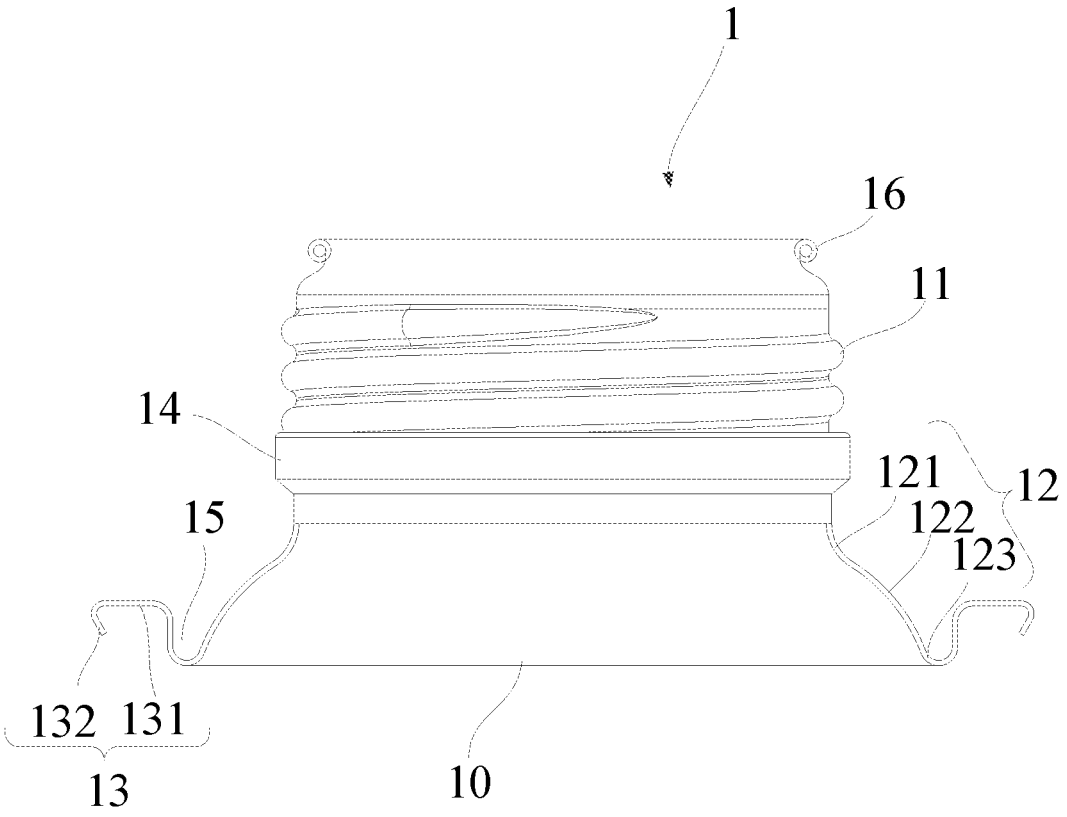
FIG. 1 is a schematic structural diagram of a metal screw cap provided in an embodiment of the present disclosure.

1-metal screw cap; 10-screw cap body;
11-threaded portion; 12-arc-shaped portion;
121-first circular arc-shaped segment; 122-second circular arc-shaped segment;
123-third circular arc-shaped segment; 13-hemming portion;
131-first hem; 132-second hem;
14-stopping portion; 15-annular groove;
16-curling edge; 20-blank;
201-preform; 21-first semi-finished product;
211-first semi-finished product annular wall I; 212-first semi-finished product annular wall II;
213-first semi-finished product annular edge; 22-second semi-finished product;
221-second semi-finished product annular wall; 23-third semi-finished product;
231-third semi-finished product annular wall; 2311-third semi-finished product annular wall I;
2312-third semi-finished product annular wall II;
24-fourth semi-finished product;
241-hem.

DESCRIPTION OF EMBODIMENTS

In order to make the purposes, technical solutions and advantages of embodiments of the present disclosure more clear, the technical solutions in the embodiments of the present disclosure will be described clearly and comprehensively with reference to the drawings. Obviously, the described embodiments are some but not all of the embodiments of the present disclosure. Based on the embodiments in the present disclosure, all other embodiments obtained by those ordinary skilled in the art without creative efforts shall fall within the protection scope of the present disclosure.

It should be noted that the terms "first" and "second" are only used for descriptive purposes, and cannot be understood as indicating or implying relative importance or implicitly indicating the number of indicated technical features. Therefore, the features defined with "first" and "second" may explicitly or implicitly include at least one of these features. In the description of the present disclosure, "a plurality of" means at least two, for example, two, three and the like, unless otherwise specifically defined.

In the present disclosure, unless otherwise clearly specified and defined, the terms "mounting", "connecting", "fixing" and the like should be understood in a broad sense. For example, connecting may be a fixed connecting, or a detachable connecting, or an integrated connecting, or may be a mechanical connecting, or an electrical connecting or a form enabling communication with each other, or may be a direct connecting, or indirect connecting via an intermediate medium, or may be a communication between two elements or an interaction between two elements, unless otherwise clearly defined. For those ordinary skilled in the art, the specific meanings of the above terms in the present disclosure may be understood according to specific situations.

In the present disclosure, unless otherwise expressly specified and defined, a first feature being "above" or "below" a second feature may be that the first feature is in direct contact with the second feature, or the first feature is in indirect contact with the second feature through an intermediate medium. Moreover, the first feature being "over", "above" and "on" the second feature may be that the first feature is right above the second feature or the first feature is obliquely upward from the second feature, or simply indicate that a horizontal level of the first feature is higher than that of the second feature. The first feature being "under", "below" and "beneath" the second feature may be that the first feature is right below the second feature or the first feature is obliquely downward from the second feature, or simply indicate that the horizontal level of the first feature is lower than that of the second feature.

In the above description, descriptions referring to the terms "an embodiment", "some embodiments", "examples", "specific examples" or "some examples" mean that specific features, structures, materials or characteristics described in connection with this embodiment or example are included in at least one embodiment or example of the present disclosure. In this specification, the schematic expressions of the above terms are not necessarily aimed at a same embodiment or example. Moreover, the specific features, structures, materials or characteristics described may be combined in a suitable manner in any one or more embodiments or examples. In addition, those skilled in the art can bond and combine different embodiments or examples and features of different embodiments or examples described in this specification without contradicting each other.

A pop-top can, due to its advantages of easy-to-carry, safe-to-use and high recycling value, is widely used in the packaging of liquid products such as beverage, beer and water, etc. In the prior art, the pop-top can includes a can body and an easy open end. The can body is provided with a turned edge, and the easy open end is provided with a curling edge. The turned edge on the can body is pressed into the curling edge on the easy open end to form an interlocking structure, and then the interlocking structure is tightly pressed to complete the seaming. However, the pop-top can in the prior art cannot be resealed after being opened, and when liquid in the pop-top can cannot be drunk up in time, it is prone to be polluted or wasted.

In order to solve the above problems, a metal screw cap, a pop-top can and a metal screw cap manufacturing method provided in the present disclosure enable the pop-top can to be resealed after being opened by arranging the metal screw cap with a threaded portion, which may prevent the liquid in the pop-top can from being polluted or wasted. Moreover, because an arc-shaped portion of the metal screw cap is arranged in a structure where a plurality of circular arc-shaped segments are connected end to end, when the arc-shaped segments are formed by pressing, or when the pop-top can is filled with liquid posing a certain pressure, the metal screw cap can keep good stability without collapsing, which is beneficial to improving the yield of the pop-top can.

The metal screw cap, the pop-top can and the metal screw cap manufacturing method provided in the present disclosure will be described below in detail with specific embodiments.

FIG. 1 is a schematic structural diagram of a metal screw cap provided in an embodiment of the present disclosure.

As shown in FIG. 1, an embodiment of the present disclosure provides a metal screw cap 1, including a metal screw cap body 10; an inner wall of the screw cap body 10 encloses a channel for liquid to flow out; the screw cap body 10 includes a threaded portion 11, an arc-shaped portion 12 and a hemming portion 13. The arc-shaped portion 12 is disposed between the threaded portion 11 and the hemming portion 13. The arc-shaped portion 12 includes a plurality of circular arc-shaped segments connected end to end; the threaded portion 11 is used for threaded sealing connection with a lid, and the hemming portion 13 is used for seaming with a turned edge of a can body.

The turned edge of the can body of the pop-top can is pressed to the hemming portion 13 of the metal screw cap 1 of the present application to form an interlocking structure, and then the interlocking structure is tightly pressed to complete the seaming, so that the pop-top can can be obtained.

One end of the hemming portion 13 is connected with the turned edge of the can body, and the other end of the hemming portion 13 is connected with the arc-shaped portion 12. The arc-shaped portion 12 is arranged such that the plurality of circular arc-shaped segments are connected end to end, so that when the circular arc-shaped segments are formed by pressing, or when the pop-top can is filled with liquid posing a certain pressure, the metal screw cap can keep good stability without collapsing, which is beneficial to improving the yield of the pop-top can. At the same time, because the arc-shaped portion of the present application protrudes from the hemming portion 13, the metal screw cap 1 has characteristics of novel appearance and superior texture compared with the existing pop-top can, so that the requirements of diversified products can be met, and the requirements of high-grade, novel and beautiful metal can packaging can also be met.

Radii of the circular arc-shaped segments of the arc-shaped portion 12 may be different or the same, and are not specifically set herein.

It should also be pointed out that with people's increasing demand for functionality of large-capacity shared products such as water, beer and beverage, the pop-top can needs to be equipped with the characteristics of resealing. In the present application, the pop-top can can be resealed after being opened, by arranging the threaded portion 11 on the arc-shaped portion 12, which can prevent the liquid in the pop-top can from being polluted or wasted.

The screw cap body 10 is made of a metal material which, for example, may be aluminum, laminated steel and the like. When the pop-top can is used to contain foods such as beer, fruit juice and the like, the screw cap body 10 should be made of a food-grade metal material. When content of the pop-top can is corrosive, the screw cap body should be made of an anti-corrosion metal material, or at least an inner surface of the screw cap body should be coated with an anti-corrosion coating.

Illustratively, the threaded portion 11 may be a threaded annular boss. A thread on the threaded portion 11 may be continuous or discontinuous, which is not specifically set in the present disclosure. The thread on the threaded portion 11 may be a single thread, a double thread, a triple thread and the like, which is not specifically set in the present disclosure. The thread on the threaded portion 11 may be a right-hand thread or a left-hand thread, which is not specifically set in the present disclosure.

Illustratively, in order to improve compressive strength of the metal screw cap 1, the arc-shaped portion 12 includes a first circular arc-shaped segment 121, a second circular arc-shaped segment 122 and a third circular arc-shaped segment 123. A ratio of a radius of the first circular arc-shaped segment 121 to a radius of the second circular arc-shaped segment 122 ranges from 1:16 to 1:1, and a ratio of the radius of the second circular arc-shaped segment 122 to a radius of the third circular arc-shaped segment 123 ranges from 1:2 to 36:1. Centers of the first circular arc-shaped segment 121 and the third circular arc-shaped segment 123 are located outside the screw cap body 10, and a center of the second circular arc-shaped segment 122 is located inside the screw cap body 10.

It should be noted that a stopping portion 14 is further provided between the arc-shaped portion 12 and the threaded portion 11. The stopping portion 14 may be an annular cylinder, and a thickness of the stopping portion 14 is greater than a maximum thickness of the threaded portion 11. The lid is screwed on the threaded portion 11 and an opening end of the lid abuts against the stopping portion 14, this can not only ensure that the lid is installed in place, but also improve the overall aesthetics of the metal screw cap 1.

Illustratively, the hemming portion 13 includes a first hem 131 and a second hem 132. One end of the first hem 131 is connected with the third circular arc-shaped segment 123, and the other end of the first hem 131 is connected with the second hem 132. When the can body is installed with the metal screw cap 1, the turned edge of the can body is placed in an area surrounded by the first hem 131 and the second hem 132. The turned edge of the can body is bent by rolling and pressing the first hem 131, and the turned edge of the can body is located between the first hem 131 and the second hem 132, then the first hem 131, the turned edge of the can body and the first hem 131 are tightly pressed to complete the seaming of the hemming portion 13 and the turned edge of the can body.

It should be noted that the metal screw cap 1 of the present application further has an advantage of being convenient to carry compared with the existing flat easy open end.

Optionally, an annular groove 15 is formed between the hemming portion 13 and the arc-shaped portion 12.

By forming the annular groove 15 between the hemming portion 13 and the arc-shaped portion 12, not only overall structural strength of the pop-top can is improved, but also the seaming between the metal screw cap 1 and the can body is facilitated, reducing the possibility of liquid leakage, and beneficial to the up-and-down stacking of pop-top cans.

Optionally, the threaded portion 11 is provided with a curling edge 16 to avoid an opening portion at a top end of the threaded portion from scratching a user and ensure the safety of using the pop-top can.

Illustratively, the threaded portion 11 includes a threaded annular boss and an unthreaded annular boss. An outer diameter of the threaded annular boss is larger than that of the unthreaded annular boss, and a curling edge 16 is formed by rolling the unthreaded annular boss via a rolling device for more than one time.

An embodiment of the present disclosure further provides a pop-top can, which includes a can body and the metal screw cap 1; the can body is provided with a turned edge, and the turned edge is seamed with the hemming portion 13 of the metal screw cap 1.

The structure of the metal screw cap 1 in the pop-top can provided in the embodiment of the present disclosure is the same as that of the above described metal screw cap, and can bring the same or similar technical effects, and thus will not be repeated here.

An embodiment of the present disclosure further provides a metal screw cap manufacturing method, including: stretching a preform 201 with a cylindrical protrusion to form a first semi-finished product 21 with a step structure; press forming a lower portion of the step structure to obtain a second semi-finished product 22 with an arc-shaped portion, where the arc-shaped portion includes a plurality of circular arc-shaped segments connected end to end; punching a top end of the step structure to obtain a third semi-finished product 23 with an opening portion; hemming an outer edge of the third semi-finished product to obtain a fourth semi-finished product 24 with a hem; and performing thread forming on the opening portion of the fourth semi-finished product 24 to obtain the metal screw cap 1.

Figure 2:
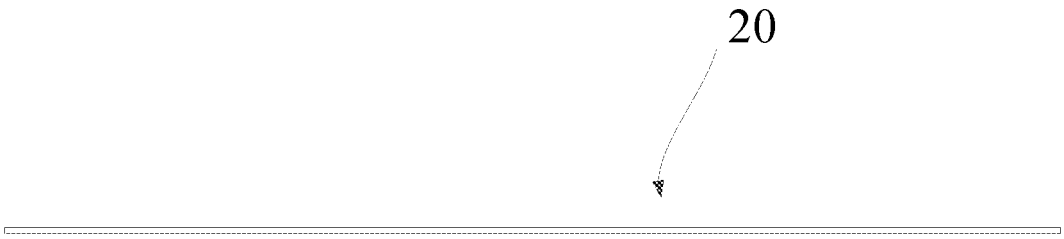
FIG. 2 is a schematic structural diagram of a blank in a metal screw cap manufacturing method provided in an embodiment of the present disclosure.
Figure 3:
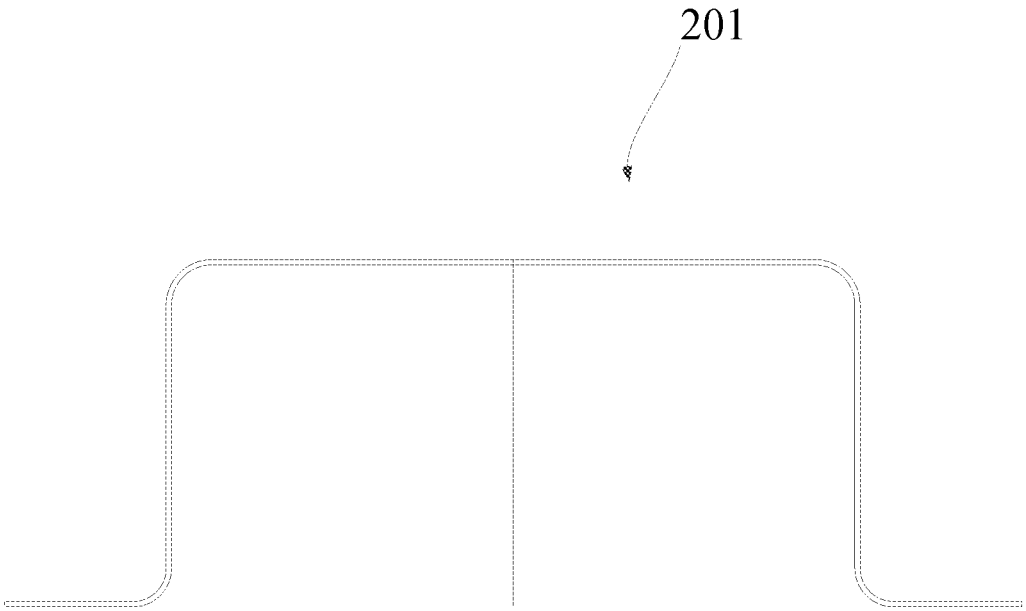
FIG. 3 is a schematic structural diagram of a preform in a metal screw cap manufacturing method provided in an embodiment of the present disclosure.

FIG. 2 is a schematic structural diagram of a blank in a metal screw cap manufacturing method provided in an embodiment of the present disclosure; and FIG. 3 is a schematic structural diagram of a preform in a metal screw cap manufacturing method provided in an embodiment of the present disclosure.

Optionally, before stretching the preform 201, the method further includes: cutting a blank 20; and blanking and punching the cut blank to form the preform 201 with the cylindrical protrusion.

The blank is a metal material. The metal material is cut to obtain the blank with a required size, and then the blank is blanked and punched by a punch press to form the preform 201 with the cylindrical protrusion.

Figure 4:
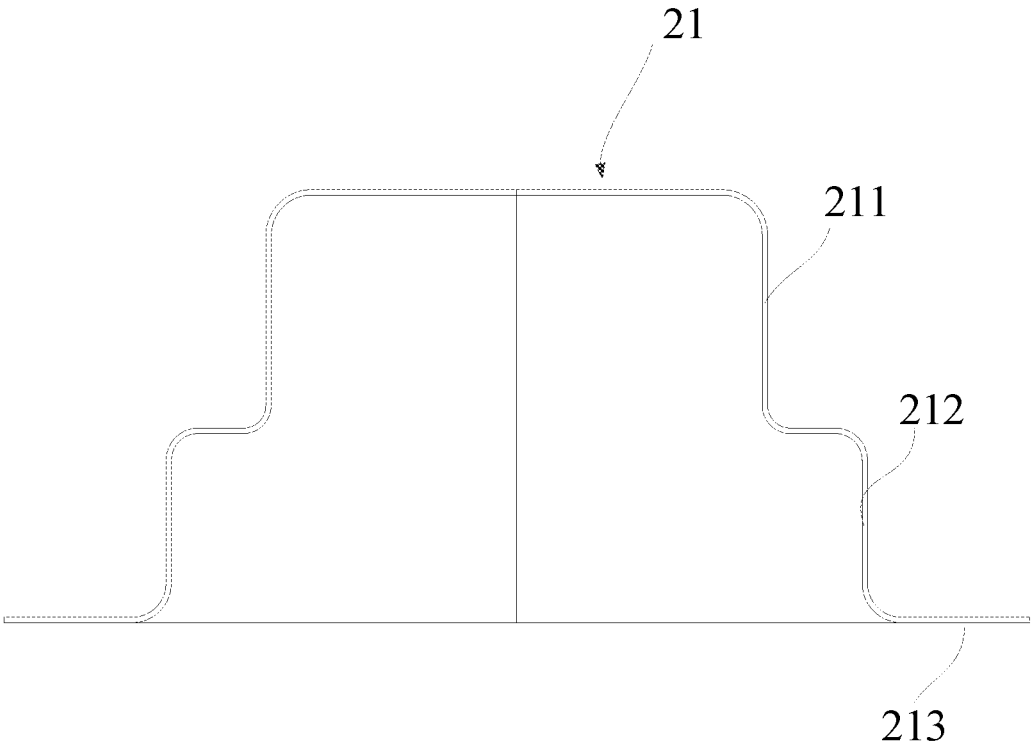
FIG. 4 is a schematic structural diagram of a first semi-finished product in a metal screw cap manufacturing method provided in an embodiment of the present disclosure.

FIG. 4 is a schematic structural diagram of a first semi-finished product in a metal screw cap manufacturing method provided in an embodiment of the present disclosure.

The preform 201 with the cylindrical protrusion is stretched to form the first semi-finished product 21 which includes first semi-finished product annular wall I 211, first semi-finished product annular wall II 212 and a first semi-finished product annular edge 213. The first semi-finished product annular wall I 211 is vertically connected with the first semi-finished product annular wall II 212, and the first semi-finished product annular edge 213 is vertically connected with the first semi-finished product annular wall II 212. The first semi-finished product annular wall I 211 is opened at one end and closed at the other end; the first semi-finished product annular wall II 212 is opened at both ends. The first semi-finished product annular wall I 211 and the first semi-finished product annular wall II 212 form the step structure.

Figure 5:
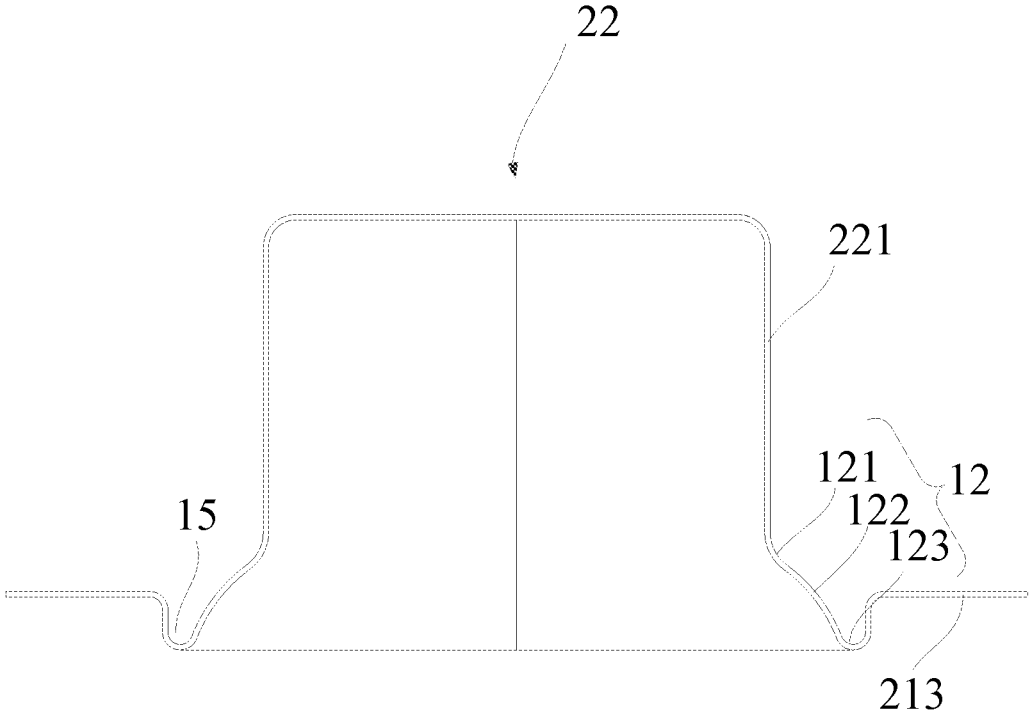
FIG. 5 is a schematic structural diagram of a second semi-finished product in a metal screw cap manufacturing method provided in an embodiment of the present disclosure.

FIG. 5 is a schematic structural diagram of a second semi-finished product in a metal screw cap manufacturing method provided in an embodiment of the present disclosure.

Press forming is performed on the lower portion of the step structure, that is, press forming is performed on the first semi-finished product annular wall II 212 to obtain the second semi-finished product 22 with an arc-shaped portion 12. The second semi-finished product 22 includes a second semi-finished product annular wall 221, the arc-shaped portion 12 and the first semi-finished product annular edge 213. The arc-shaped portion 12 includes a plurality of circular arc-shaped segments.

The arc-shaped portion 12 includes a first circular arc-shaped segment 121, a second circular arc-shaped segment 122 and a third circular arc-shaped segment 123. A ratio of a radius of the first circular arc-shaped segment 121 to a radius of the second circular arc-shaped segment 122 ranges from 1:16 to 1:1, and a ratio of the radius of the second circular arc-shaped segment 122 to a radius of the third circular arc-shaped segment 123 ranges from 1:2 to 36:1. Centers of the first circular arc-shaped segment 121 and the third circular arc-shaped segment 123 are located outside the screw cap body 10, and a center of the second circular arc-shaped segment 122 is located inside the screw cap body 10.

It should be noted that an annular groove 15 is formed between the first semi-finished product annular edge 213 and the arc-shaped portion 12, which not only improves the overall structural strength of the pop-top can, but also facilitates the seaming between the metal screw cap 1 and the can body, reduces the possibility of liquid leakage, and is also benefit to the up-and-down stacking of pop-top cans.

Figure 6A:
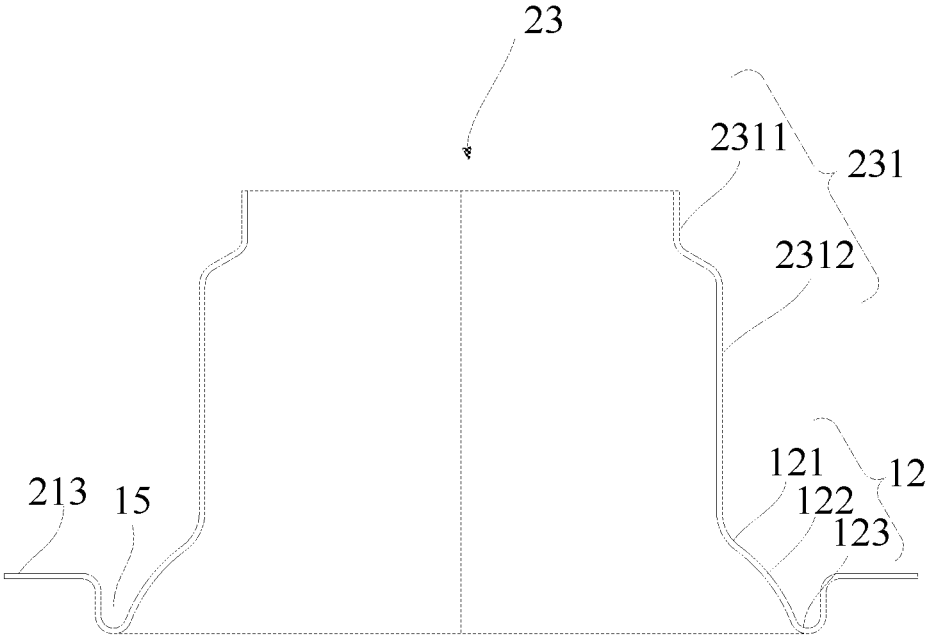
FIG. 6*a* and FIG. 6*b* are schematic structural diagrams of a third semi-finished product in a metal screw cap manufacturing method provided in an embodiment of the present disclosure.
Figure 6B:
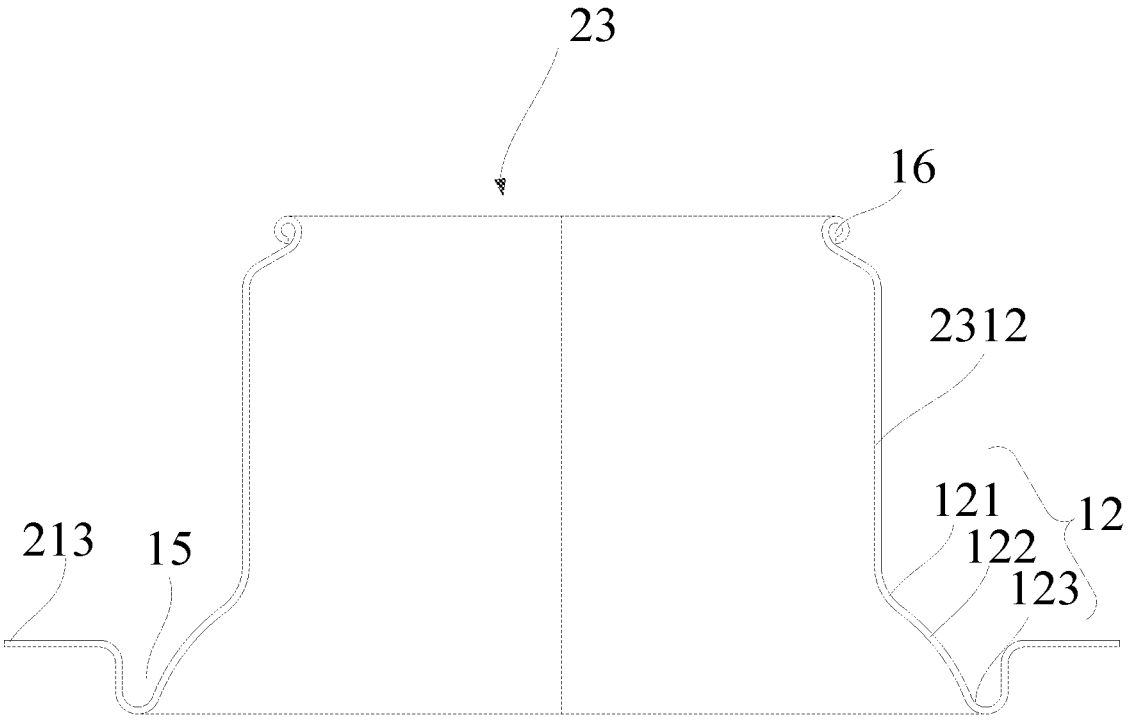

FIG. 6*a* and FIG. 6*b* are schematic structural diagrams of a third semi-finished product in a metal screw cap manufacturing method provided in an embodiment of the present disclosure.

Optionally, the top end of the step structure is punched, that is, a top end of the second semi-finished product annular wall 221 is punched, to obtain the third semi-finished product 23 with the opening portion. The third semi-finished product 23 includes a third semi-finished product annular wall 231, the arc-shaped portion 12 and the first semi-finished product annular edge 213. The third semi-finished product annular wall 231 is first necked at the opening portion to obtain a third semi-finished product annular wall I 2311 and a third semi-finished product annular wall II 2312, and then the third semi-finished product annular wall I 2311 is bent and pre-curled to obtain the curling edge 16.

It should be noted that the second semi-finished product annular wall 221 is punched to obtain the third semi-finished product annular wall 231 opened at both ends.

Figure 7A:
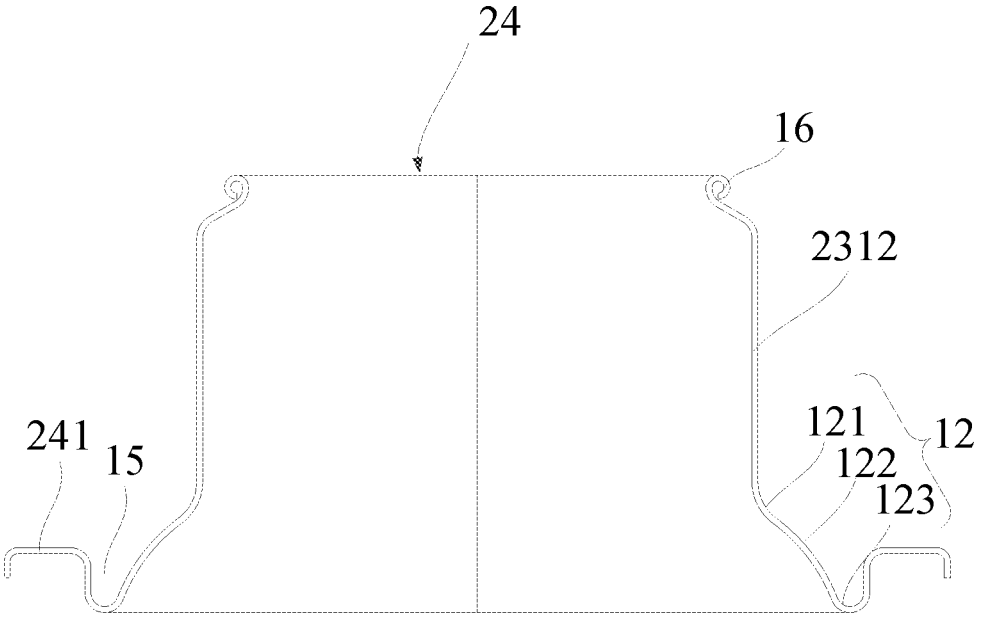
FIG. 7*a* and FIG. 7*b* are schematic structural diagrams of a fourth semi-finished product in a metal screw cap manufacturing method provided in an embodiment of the present disclosure.
Figure 7B:
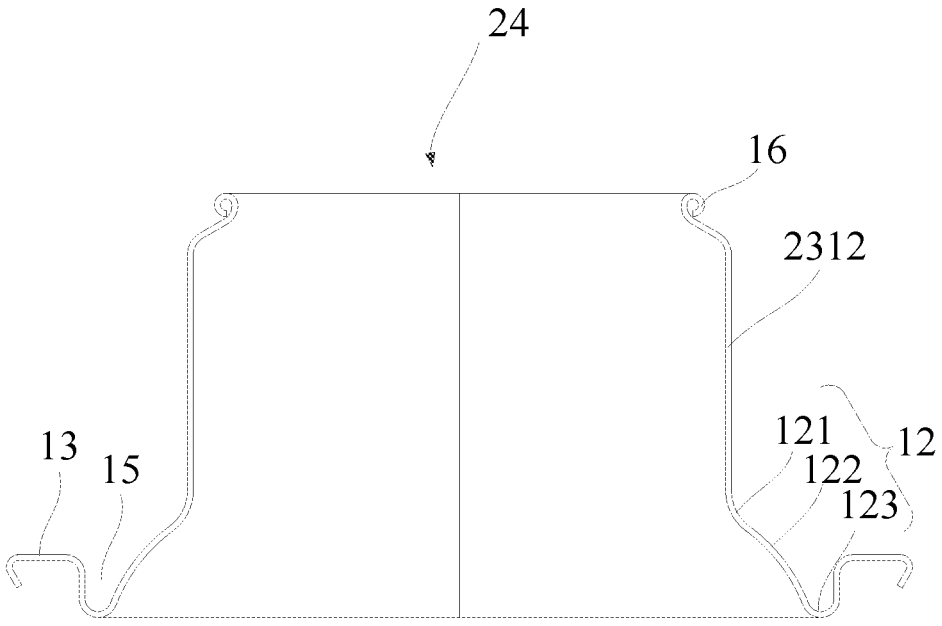

FIG. 7*a* and FIG. 7*b* are schematic structural diagrams of a fourth semi-finished product in a metal screw cap manufacturing method provided in an embodiment of the present disclosure.

Optionally, an outer edge of the third semi-finished product 23 is hemmed, that is, the first semi-finished product annular edge 213 is hemmed to obtain the fourth semi-finished product 24 with a hem. The fourth semi-finished product 24 includes the curling edge 16, the third semi-finished product annular wall II 2312, the arc-shaped portion 12 and a hem 241. A hemming portion 13 is obtained by rounding the hem 241. The hemming portion 13 includes a first hem 131 and a second hem 132.

Figure 8:
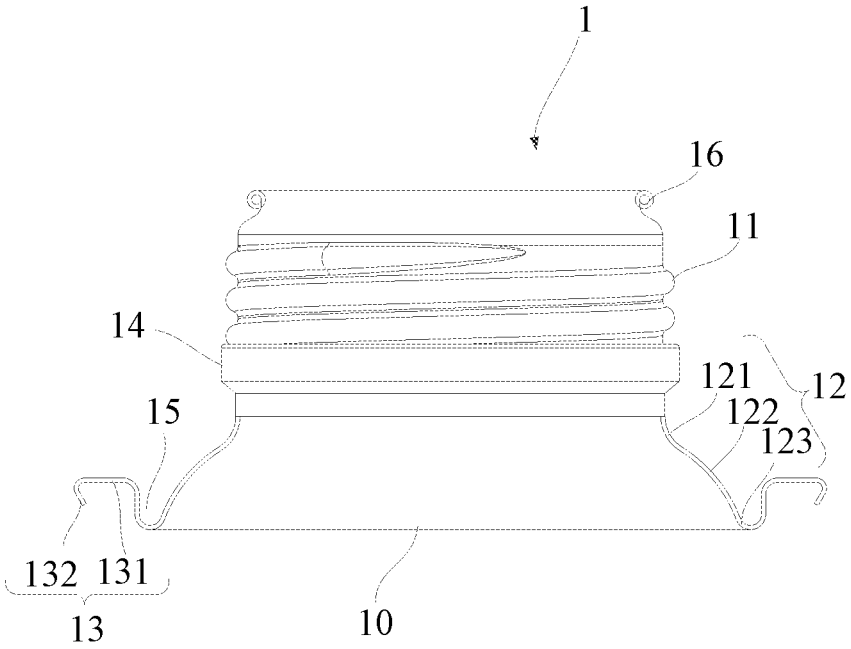
FIG. 8 is a schematic structural diagram of a metal screw cap in a metal screw cap manufacturing method provided in an embodiment of the present disclosure.

FIG. 8 is a schematic structural diagram of a metal screw cap in a metal screw cap manufacturing method provided in the present disclosure.

Thread forming is performed on the opening portion of the fourth semi-finished product 24, that is, thread forming is performed on the third semi-finished product annular wall II 2312 to obtain a threaded portion 11 and a stopping portion 14, and finally the metal screw cap 1 is obtained. The metal screw cap 1 includes the curling edge 16, the threaded portion 11, the stopping portion 14, the arc-shaped portion 12, the hemming portion 13 and the annular groove 15.

Embodiment 1: The Metal Screw Cap 1 is Made of Aluminum

Before stretching the preform 201, the method further includes: cutting the blank 20; and blanking and punching the cut blank to form the preform 201 with the cylindrical protrusion.

The blank is aluminum, and the aluminum is cut to obtain the blank with a required size, and then the blank is blanked and punched by a punch press to form the preform 201 with the cylindrical protrusion.

The preform 201 with the cylindrical protrusion is stretched to form the first semi-finished product 21, which includes first semi-finished product annular wall I 211, first semi-finished product annular wall II 212 and a first semi-finished product annular edge 213. The first semi-finished product annular wall I 211 is vertically connected with the first semi-finished product annular wall II 212, and the first semi-finished product annular edge 213 is vertically connected with the first semi-finished product annular wall II 212. The first semi-finished product annular wall I 211 is opened at one end and closed at the other end; the first semi-finished product annular wall II 212 is opened at both ends. The first semi-finished product annular wall I 211 and the first semi-finished product annular wall II 212 form the step structure.

Press forming is performed on the lower portion of the step structure, that is, press forming is performed on the first semi-finished product annular wall II 212 to obtain the second semi-finished product 22 with an arc-shaped portion 12. The second semi-finished product 22 includes a second semi-finished product annular wall 221, the arc-shaped portion 12 and the first semi-finished product annular edge 213. The arc-shaped portion 12 includes a plurality of circular arc-shaped segments.

The arc-shaped portion 12 includes a first circular arc-shaped segment 121, a second circular arc-shaped segment 122 and a third circular arc-shaped segment 123. A ratio of a radius of the first circular arc-shaped segment 121 to a radius of the second circular arc-shaped segment 122 ranges from 1:16 to 1:1, and a ratio of the radius of the second circular arc-shaped segment 122 to a radius of the third circular arc-shaped segment 123 ranges from 1:2 to 36:1. Centers of the first circular arc-shaped segment 121 and the third circular arc-shaped segment 123 are located outside the screw cap body 10, and a center of the second circular arc-shaped segment 122 is located inside the screw cap body 10.

It should be noted that an annular groove 15 is formed between the first semi-finished product annular edge 213 and the arc-shaped portion 12, which not only improves the overall structural strength of the pop-top can, but also facilitates the seaming between the metal screw cap 1 and the can body, reduces the possibility of liquid leakage, and is also benefit to the up-and-down stacking of pop-top cans.

The top end of the step structure is punched, that is, a top end of the second semi-finished product annular wall 221 is punched, to obtain the third semi-finished product 23 with the opening portion. The third semi-finished product 23 includes a third semi-finished product annular wall 231, the arc-shaped portion 12 and the first semi-finished product annular edge 213. The third semi-finished product annular wall 231 is first necked at the opening portion to obtain a third semi-finished product annular wall I 2311 and a third semi-finished product annular wall II 2312, and then the third semi-finished product annular wall I 2311 is bent and pre-curled to obtain the curling edge 16.

It should be noted that the second semi-finished product annular wall 221 is punched to obtain the third semi-finished product annular wall 231 opened at both ends.

An outer edge of the third semi-finished product 23 is hemmed, that is, the first semi-finished product annular edge 213 is hemmed to obtain the fourth semi-finished product 24 with a hem. The fourth semi-finished product 24 includes the curling edge 16, the third semi-finished product annular wall II 2312, the arc-shaped portion 12 and a hem 241. A hemming portion 13 is obtained by rounding the hem 241. The hemming portion 13 includes a first hem 131 and a second hem 132.

Thread forming is performed on the opening portion of the fourth semi-finished product 24, that is, thread forming is performed on the third semi-finished product annular wall II 2312 to obtain a threaded portion 11 and a stopping portion 14, and finally the metal screw cap 1 is obtained. The metal screw cap 1 includes the curling edge 16, the threaded portion 11, the stopping portion 14, the arc-shaped portion 12, the hemming portion 13 and the annular groove 15.

Embodiment 2: The Metal Screw Cap 1 is Made of Laminated Steel

Before stretching the preform 201, the method further includes: cutting the blank 20; and blanking and punching the cut blank to form the preform 201 with the cylindrical protrusion.

The blank is laminated steel, and the laminated steel is cut to obtain the blank with a required size, and then the blank is blanked and punched by a punch press to form the preform 201 with the cylindrical protrusion.

The preform 201 with the cylindrical protrusion is stretched twice to form the first semi-finished product 21. The first semi-finished product 21 includes first semi-finished product annular wall I 211, first semi-finished product annular wall II 212 and a first semi-finished product annular edge 213. The first semi-finished product annular wall I 211 is vertically connected with the first semi-finished product annular wall II 212, and the first semi-finished product annular edge 213 is vertically connected with the first semi-finished product annular wall II 212. The first semi-finished product annular wall I 211 is opened at one end and closed at the other end; the first semi-finished product annular wall II 212 is opened at both ends. The first semi-finished product annular wall I 211 and the first semi-finished product annular wall II 212 form the step structure.

When the preform 201 is stretched for a first time, the preform 201 is stretched to be of a structure with a first annular wall, a second annular wall and a first annular edge. The first annular wall is vertically connected with the second annular wall, and the first annular edge is vertically connected with the second annular wall. The first annular wall is opened at one end and closed at the other end; and the second annular wall is opened at both ends. The first annular wall and the second annular wall form the step structure.

When the preform 201 is stretched for a second time, a diameter of the first annular wall decreases and a length thereof increases to form the first semi-finished product annular wall I 211, while a diameter of the second annular wall increases to form the first semi-finished product annular wall II 212, and the first annular edge remains unchanged to form the first semi-finished product annular edge 213, thereby forming the first semi-finished product 21.

Press forming is performed on the lower portion of the step structure, that is, press forming is performed on the first semi-finished product annular wall II 212 to obtain the second semi-finished product 22 with an arc-shaped portion 12. The second semi-finished product 22 includes a second semi-finished product annular wall 221, the arc-shaped portion 12 and the first semi-finished product annular edge 213. The arc-shaped portion 12 includes a plurality of circular arc-shaped segments.

The arc-shaped portion 12 includes a first circular arc-shaped segment 121, a second circular arc-shaped segment 122 and a third circular arc-shaped segment 123, a ratio of a radius of the first circular arc-shaped segment 121 to a radius of the second circular arc-shaped segment 122 ranges from 1:16 to 1:1, and a ratio of the radius of the second circular arc-shaped segment 122 to a radius of the third circular arc-shaped segment 123 ranges from 1:2 to 36:1. Centers of the first circular arc-shaped segment 121 and the third circular arc-shaped segment 123 are located outside the screw cap body 10, and a center of the second circular arc-shaped segment 122 is located inside the screw cap body 10.

It should be noted that an annular groove 15 is formed between the first semi-finished product annular edge 213 and the arc-shaped portion 12, which not only improves the overall structural strength of the pop-top can, but also facilitates the seaming between the metal screw cap 1 and the can body, reduces the possibility of liquid leakage, and is also benefit to the up-and-down stacking of pop-top cans.

The top end of the step structure is punched, that is, a top end of the second semi-finished product annular wall 221 is punched to obtain the third semi-finished product 23 with the opening portion. The third semi-finished product 23 includes a third semi-finished product annular wall 231, the arc-shaped portion 12 and the first semi-finished product annular edge 213. The third semi-finished product annular wall 231 is first necked at the opening portion to obtain a third semi-finished product annular wall I 2311 and a third semi-finished product annular wall II 2312, and then the third semi-finished product annular wall I 2311 is bent and pre-curled to obtain the curling edge 16. An outer edge of the third semi-finished product 23 is hemmed, that is, the first semi-finished product annular edge 213 is hemmed to obtain the fourth semi-finished product 24 with a hem. The fourth semi-finished product 24 includes the curling edge 16, the third semi-finished product annular wall II 2312, the arc-shaped portion 12 and a hem 241. A hemming portion 13 is obtained by rounding the hem 241. The hemming portion 13 includes a first hem 131 and a second hem 132.

Thread forming is performed on the opening portion of the fourth semi-finished product 24, that is, thread forming is performed on the third semi-finished product annular wall II 2312 to obtain a threaded portion 11 and a stopping portion 14, and finally the metal screw cap 1 is obtained. The metal screw cap 1 includes the curling edge 16, the threaded portion 11, the stopping portion 14, the arc-shaped portion 12, the hemming portion 13 and the annular groove 15.

Finally, it should be noted that the above embodiments are only used to illustrate the technical solutions of the present disclosure, rather than limiting them. Although the present disclosure has been described in detail with reference to the foregoing embodiments, it should be understood by those skilled in the art: the technical solutions recorded in the foregoing embodiments may still be modified, or some or all of their technical features may be substituted by equivalents; however, these modifications or substitutions do not make the essence of the corresponding technical solutions depart from the scope of the technical solutions of various embodiments of the present disclosure.

What is claimed is:

1. A metal screw cap, applied for a pop-top can and comprising a screw cap body;

wherein an inner wall of the screw cap body encloses a channel for liquid to flow out; and the screw cap body comprises a threaded portion, an arc-shaped portion and a hemming portion, the arc-shaped portion is disposed between the threaded portion and the hemming portion, the arc-shaped portion comprises a plurality of circular arc-shaped segments connected end to end, the threaded portion is used for threaded sealing connection with a lid, and the hemming portion is used for seaming with a turned edge of a can body;

a stopping portion is provided between the arc-shaped portion and the threaded portion, and a thickness of the stopping portion is greater than a maximum thickness of the threaded portion.

2. The metal screw cap according to claim 1, wherein the arc-shaped portion comprises a first circular arc-shaped segment, a second circular arc-shaped segment and a third circular arc-shaped segment, a ratio of a radius of the first circular arc-shaped segment to a radius of the second circular arc-shaped segment ranges from 1:16 to 1:1, and a ratio of the radius the second circular arc-shaped segment to a radius of the third circular arc-shaped segment ranges from 1:2 to 36:1.

3. The metal screw cap according to claim 2, wherein an annular groove is formed between the hemming portion and the arc-shaped portion; and/or, the hemming portion comprises a first hem and a second hem, one end of the first hem is connected with the third circular arc-shaped segment, and the other end of the first hem is connected with the second hem.

4. The metal screw cap according to claim 1, wherein the threaded portion is provided with a curling edge.

5. The metal screw cap according to claim 2, wherein the threaded portion is provided with a curling edge.

6. The metal screw cap according to claim 3, wherein the threaded portion is provided with a curling edge.

7. A pop-top can, comprising a can body and the metal screw cap according to claim 1;

wherein the can body is provided with a turned edge, and the turned edge is seamed with the hemming portion of the metal screw cap.

8. The pop-top can according to claim 7, wherein the arc-shaped portion comprises a first circular arc-shaped segment, a second circular arc-shaped segment and a third circular arc-shaped segment, a ratio of a radius of the first circular arc-shaped segment to a radius of the second circular arc-shaped segment ranges from 1:16 to 1:1, and a ratio of the radius the second circular arc-shaped segment to a radius of the third circular arc-shaped segment ranges from 1:2 to 36:1.

9. The pop-top can according to claim 8, wherein an annular groove is formed between the hemming portion and the arc-shaped portion; and/or, the hemming portion comprises a first hem and a second hem, one end of the first hem is connected with the third circular arc-shaped segment, and the other end of the first hem is connected with the second hem.

10. The pop-top can according to claim 7, wherein the threaded portion is provided with a curling edge.

* * * * *